US007127078B2

(12) United States Patent
Mann et al.

(10) Patent No.: US 7,127,078 B2
(45) **Date of Patent: *Oct. 24, 2006**

(54) IMPLANTED OUTER EAR CANAL HEARING AID

(75) Inventors: Alfred E. Mann, Beverly Hills, CA (US); Albert S. Maltan, Sistrans (AU); Yitzhak Zilberman, Santa Clarita, CA (US); Byron L. Moran, Santa Barbara, CA (US); Ronald J. Lebel, Sherman Oaks, CA (US)

(73) Assignees: Advanced Bionics Corporation, Sylmar, CA (US); Medical Research Products-B, Sylmar, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/702,565

(22) Filed: Nov. 5, 2003

(65) Prior Publication Data

US 2004/0133066 A1 Jul. 8, 2004

Related U.S. Application Data

(63) Continuation-in-part of application No. 10/264,937, filed on Oct. 3, 2002, now Pat. No. 6,879,695.

(60) Provisional application No. 60/424,912, filed on Nov. 8, 2002, provisional application No. 60/327,099, filed on Oct. 3, 2001, provisional application No. 60/327,071, filed on Oct. 3, 2001.

(51) Int. Cl.
*H04R 25/00* (2006.01)

(52) U.S. Cl. ..... 381/326; 379/324

(58) Field of Classification Search ..... 381/315, 381/322–324, 326, 380
See application file for complete search history.

(56) References Cited

U.S. PATENT DOCUMENTS

| | | | |
|---|---|---|---|
| 3,068,954 | A | 12/1962 | Strzalkowski |
| 3,557,775 | A | 1/1971 | Mahoney |
| 3,844,271 | A | 10/1974 | Lake |
| 4,957,478 | A | 9/1990 | Maniglia |
| 5,015,224 | A | 5/1991 | Mniglia |
| 5,411,467 | A | 5/1995 | Hortmann et al. |
| 5,430,801 | A | 7/1995 | Hill |
| 5,814,095 | A | 9/1998 | Muller et al. |
| 5,833,626 | A | 11/1998 | Leysieffer |
| 5,999,632 | A | 12/1999 | Leysieffer et al. |

(Continued)

FOREIGN PATENT DOCUMENTS

DE 19854360 A1 8/1999

(Continued)

OTHER PUBLICATIONS

Retro-X Technology, Auric Hearing Systems, "Das Horsystem Mit Retroauricularer Schallfuhrung", printed Sep. 27, 2001, 1 page.

*Primary Examiner*—Curtis Kuntz
*Assistant Examiner*—Phylesha Dabney
(74) *Attorney, Agent, or Firm*—Freilich, Hornbaker & Rosen

(57) ABSTRACT

A hearing aid system including an implant (60) configured for insertion into a recess (40) formed under the skin of the retro-auricular space (50), which implant does not occlude the ear canal (30). The implant includes electronic circuitry (72), a transducer (65, e.g., speaker), antenna (64), and power source (66). The hearing aid also includes an external module (70), which module includes a microphone (163), electronics (172), antenna (164), and power source (166). A telemetry link (76) between the external module antenna and the implant antenna allows transmissions between the microphone module and the implant.

21 Claims, 7 Drawing Sheets

U.S. PATENT DOCUMENTS

| | | | | |
|---|---|---|---|---|
| 6,022,311 | A | 2/2000 | Juneau et al. | |
| 6,094,493 | A | 7/2000 | Borowsky et al. | |
| 6,099,462 | A | 8/2000 | a Wengen | |
| 6,164,284 | A | 12/2000 | Schulman et al. | |
| 6,185,452 | B1 | 2/2001 | Schulman et al. | |
| 6,208,894 | B1 | 3/2001 | Schulman et al. | |
| 6,228,020 | B1 | 5/2001 | Juneau et al. | |
| 6,254,526 | B1 | 7/2001 | Juneau et al. | |
| 6,473,513 | B1 | 10/2002 | Shennib et al. | |
| 6,537,200 | B1 * | 3/2003 | Leysieffer et al. | 600/25 |
| 6,694,034 | B1 | 2/2004 | Julstrom et al. | |
| 6,718,043 | B1 | 4/2004 | Boesen | |
| 6,879,693 | B1 * | 4/2005 | Miller et al. | 381/60 |
| 6,879,695 | B1 * | 4/2005 | Maltan et al. | 381/315 |
| 2001/0053871 | A1 | 12/2001 | Zilberman et al. | |
| 2001/0053872 | A1 | 12/2001 | Zilberman et al. | |
| 2001/0056291 | A1 | 12/2001 | Zilberman et al. | |
| 2003/0031336 | A1 | 2/2003 | Harrison et al. | |
| 2003/0063764 | A1 | 4/2003 | Maltan et al. | |
| 2003/0086583 | A1 | 5/2003 | Maltan et al. | |

FOREIGN PATENT DOCUMENTS

| | | | |
|---|---|---|---|
| DE | 19943907 | A1 | 3/2001 |
| DE | 20018528 | U1 | 4/2001 |
| DE | 20108827 | U1 | 10/2001 |
| WO | WO-03/030772 | A3 | 4/2003 |

* cited by examiner

IMPLANTED OUTER EAR CANAL HEARING AID

RELATED APPLICATIONS

This application is a continuation-in-part of U.S. application Ser. No. 10/264,937 filed on Oct. 3, 2002 (now U.S. Pat. No. 6,879,695 issued Apr. 12, 2005) which claims priority based on Provisional Applications 60/327,099 filed Oct. 3, 2001 and 60/327,071 filed Oct. 3, 2001. The present application also claims priority based on Provisional Application 60/424,912 filed Nov. 8, 2002.

BACKGROUND OF THE INVENTION

Traditionally, most hearing aids capture sound through a microphone that delivers an amplified and/or modified version of the sound signal into the user's ear canal through a suitable electrical-to-audio transducer, e.g., a small speaker. The proximity of the microphone to the transducer can disadvantageously produce audio feedback from the transducer to the microphone. The present invention relates to a hearing aid system that includes a transducer configured for implantation to project acoustic energy into a patient's outer ear canal in combination with a remote microphone.

The solution in the past for eliminating feedback has been to occlude the ear canal via an ear mold such that the transducer is located distally to the occlusion, while the microphone is located proximally to the occlusion. Unfortunately, occlusion of the ear canal can create several disadvantages for the user, such as reverberation and physical discomfort, and is a major cause for non-use of traditional hearing aids by the hearing impaired.

In addition, it is desirable to make hearing aids less visible, as most users perceive the aid as imparting a negative stigma. Thus, hearing aids are continuously becoming smaller and have moved from behind the ear into the outer ear and into the canal of the ear.

It is known in the art to connect the retro-auricular space (space behind the pinna of the ear) to the ear canal via a hollow titanium tube that is permanently placed into a tunnel through the tissue. See, e.g., U.S. Pat. No. 6,094,493, which patent is incorporated herein by reference. In one embodiment of the '493 patent, an amplification hearing aid is connected to the proximal (retro-auricular) end of the tube. The hearing aid is thus located behind the pinna of the ear and a transducer sends the amplified sound signal through the tube into the ear canal. This concept, which has been commercialized by Auric® Hearing Systems, Inc. of Charlotte, N.C. as the RetroX technology, allows a certain degree of amplification without feedback and without the need for occlusion of the ear canal. In another embodiment of the '493 patent, the microphone, transducer, electrical and electronic components are installed in the tube.

Although hearing amplification via the '493 patent is achieved without occluding the ear canal, the tunnel leaves a continuous opening which is subject to infection and inflammation. In addition, although the described invention provides improvements over traditional hearing aids, the user still has the burden of maintenance associated with body-mounted hearing devices. These burdens include (1) frequent replacement of a tiny battery within an enclosed battery chamber, (2) removal of the miniature device from its mounting in the retro-auricular space for showering and water sports, and (3) expelling water from the hollow tubular element after exposure to moisture.

Improvements to the system referenced above have been described in patent applications by Advanced Bionics, Inc. However, the tunnel providing the continuous opening between the retro-auricular space and the ear canal remains, with its associated risks for infection and inflammation.

In U.S. Pat. No. 5,430,801, the use of a silicone tube "sound conductor" with similar infection and inflammation risks is disclosed. The sound conductor is physically attached to the electronics package of the hearing aid, and directs the output from the electronics into the ear canal by extending through the skin of the retro-auricular space. A microphone is positioned in the conchal bowl of the user, and the electronics package is connected to the microphone and held behind the pinna via a piercing through the cartilage of the concha.

Several concepts for implanting all or part of the hearing aid into the middle ear have been developed. Such approaches couple an amplified and processed version of the sound signal to structures of the middle ear mechanically, thereby reducing feedback without occlusion of the ear canal. Such systems also reduce or eliminate visibility of the hearing aid, and have the potential for improving user comfort. Disadvantageously, however, such middle-ear-coupled systems require, inter alia a significant surgical procedure.

SUMMARY OF THE INVENTION

The present invention is directed to a hearing aid system that includes an implanted portion (or "implant") configured for implanting in a recess formed in the soft tissue and/or cartilage between a patient's ear canal and under the skin of the retro-auricular space behind the pinna. The implant preferably comprises a case having a proximal end and a distal end. The case is intended for implantation such that the proximal end is subcutaneously implanted proximate to the patient's retro-auricular space and the distal end is implanted proximate to the patient's ear canal. A transducer is mounted at the case distal end for projecting an acoustic output signal into the patient's outer ear canal. The distal end may be positioned just under the skin of the ear canal, or may slightly percutaneously protrude into the canal. In the latter situation, the patient's skin may grow around and seal the protrusion.

A hearing aid system in accordance with the invention also includes a microphone located remote from the implant case; e.g., in an external housing carried by the user. In accordance with the invention, the microphone produces an output signal representative of audible sound. In accordance with a preferred system embodiment, wireless telemetry means couples the microphone output signal to signal processing circuitry in the implant for driving the transducer.

In a preferred embodiment, the implant case includes a power source, an antenna, the aforementioned transducer and electronic circuitry. A preferred external housing includes a power source, an antenna, the aforementioned microphone and electronic circuitry. In operation, the microphone responds to audible sound to transmit a signal via the external housing antenna to the implant case antenna to enable the implant electronic circuitry to drive the transducer to project acoustic energy into the patient's outer ear canal.

A preferred implant embodiment is implemented using a rechargeable/replenishable power source which preferably can be recharged/replenished through the skin. The preferred implementation takes advantage of advanced battery and microelectronic developments to achieve a size sufficiently small to be accommodated in the recess formed between the patient's retro-auricular space and ear canal.

The external microphone housing can be worn by the user, for instance, as an ornamental object on the chest or elsewhere, such as a pen or broach, or at the belt, or may be clipped underneath clothing. Physical separation between the microphone and the implant permits a greater gain setting before feedback occurs. The external housing containing the microphone may also be used as a remote control unit, with adjustments for volume and hearing profile, for instance.

Alternatively, the remote control unit may be separate from the external microphone. For instance, the microphone may be worn as an earring, shielded from the ear canal by the pinna, with the remote control unit located elsewhere. In another configuration, the microphone can be worn on the ear opposite the implant. Alternatively, fully assisted binaural hearing can be provided using two implants (one for each ear) that simultaneously communicate with one centrally located dual channel microphone module, which contains two sets of directional microphones configured to preferentially recover sound independently from each side of the body. Two or more microphone modules, communicating with one or two implants, may be positioned to maximize sound recovery, which may be microphone-position dependent. One or more hearing profiles, customized for each user, may be programmed by a practitioner into the electronics of the external microphone module, remote control unit (if separate from the microphone module), and/or the implant. Hearing profile programming is standard practice with conventional digital hearing aids.

In some embodiments, the signal processing circuitry processes signals received by the microphone so the sounds emitting from the transducer are compatible with the sounds traveling naturally through ear canal. The signal processing circuits may also contain circuitry that performs other electronic or signal processing functions, such as voice command recognition.

In additional embodiments, telemetry circuits and/or connector(s) allow communication with external devices, such as an external programmer (e.g., remote control unit), telephone land line or cellular network (e.g., USTM network), computer, television, and/or radio.

BRIEF DESCRIPTION OF THE DRAWINGS

The above and other aspects of the present invention will be more apparent from the following more particular description thereof, presented in conjunction with the following drawings wherein.

Corresponding reference characters indicate corresponding components throughout the several views of the drawings.

DETAILED DESCRIPTION

Figure 1:
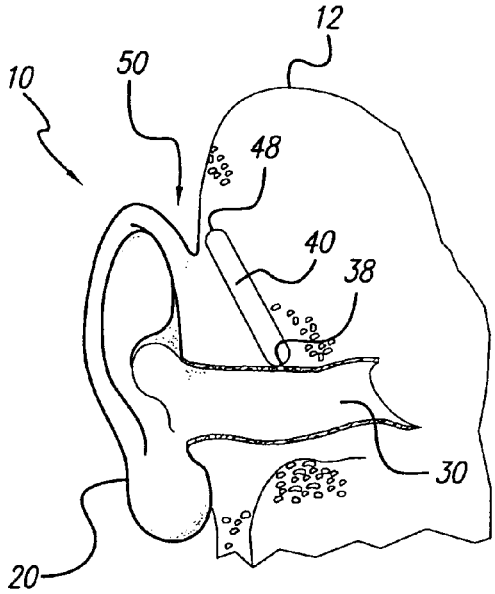
FIG. 1 schematically shows the location of a recess made in tissue under the skin of the retro-auricular space, in which a chronically implanted portion of a hearing aid of the invention may be placed.

Turning first to FIG. 1, there is shown a schematic representation of an ear 10 attached to the head 12 of a user of the present invention (or a patient who benefits from use of the present invention). FIG. 1 is a front view of the ear 10, i.e., as seen when looking at the front of the head (i.e., face) of the user. The ear 10 has a pinna 20 (a.k.a. auricle) and an ear canal 30. The space behind the pinna 20 is known as the retro-auricular space 50, which space is not readily seen or observed when others look at the user.

In accordance with the present invention, a small recess 40 is made through tissue under the skin of the retro-auricular space 50, extending toward the ear canal 30. Such recess-making is readily accomplished because of the soft tissue and/or relatively soft cartilage in this region; thus, the process is medically a relatively simple procedure. The recess 40 need not be very long, e.g., on the order of about 7_25 mm in length, and about 3_10 mm in diameter, depending upon the dimensions of the patient's ear in whom the recess is made and the particular implant design used for the patient. The implant may also be oval in cross-section, with a major diameter of 6_12 mm and a minor diameter of 3_10 mm.

For purposes of the present invention, the point at which the recess 40 ends under the skin of the retro-auricular space 50 is referred to as the proximal end 48 of recess 40. Similarly, the point at which recess 40 ends near or at the ear canal 30 is referred to as the distal end 38 of recess 40.

Figure 2A:
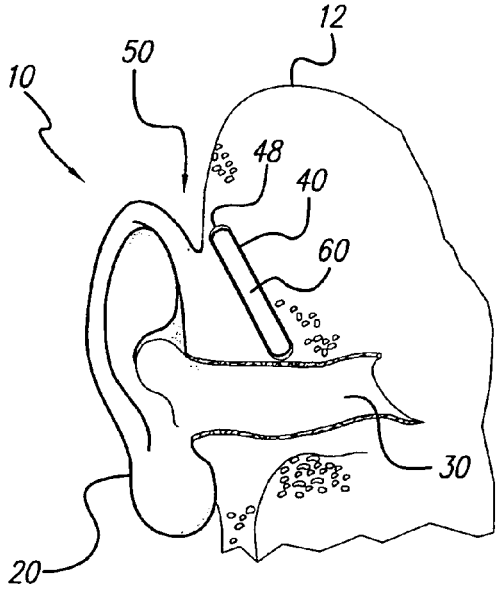
FIG. 2A shows an exemplary placement of the implanted portion of the hearing aid of the invention in the recess shown in FIG. 1.
Figure 2B:
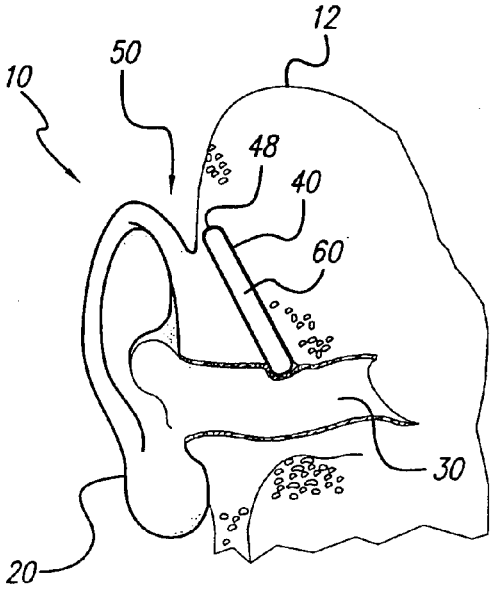
FIG. 2B shows another exemplary placement of the implanted portion of the hearing aid of the invention in the recess shown in FIG. 1.

Turning next to FIGS. 2A and 2B, there is shown two possible placements of an implanted portion 60 (discussed more fully below in conjunction with the description of FIGS. 3, 4A, 5A, 6A, 6B, 7A, 7B, and 7C) of the present invention. In FIG. 2A, implant 60 extends from just under the skin of retro-auricular space 50 to just under the skin of ear canal 30. Thus, in this configuration, recess 40 is completely enclosed and implant 60 is fully implanted.

In FIG. 2B, implant 60 extends from just under the skin of retro-auricular space 50 and into the ear canal 30. This configuration allows the transducer (e.g., speaker) of implant 60 to protrude slightly into the ear canal 30. After implantation in this manner, the skin of ear canal 30 will likely grow over or into the slight protrusion of implant 60, thus sealing recess 40 and again making implant 60 fully implanted. In some embodiments and as described in more detail presently, material(s) are provided on the distal end of implant 60 to facilitate such tissue growth over or into the implant.

Mathematical modeling was performed in April, 2002, on the outer ear canal to determine the feasibility of injecting acoustic energy into the outer ear canal, and to determine the sensitivity to placement of the acoustic sound emitter (transducer, e.g., speaker) within the canal. The results indicated that injection of sound from less than 25% to greater than 75% depth within the canal results in fairly uniform response across the frequency spectrum. Signal loss is minimal at higher frequencies (greater than 1 kHz), and tolerable down to less than 200 Hz. It is anticipated that, from a surgical perspective, the precision of implant 60 placement will not be critical. It is further anticipated that the hearing aid device of the present invention can compensate for severe high frequency hearing loss, and at least moderate low frequency hearing loss. An experiment was performed in June, 2002, on an ear simulator, and the results of the experiment validated the mathematical model. Mannequin tests indicate feedback isolation of greater than about 53 db at twelve inches distance between ear and microphone (oscillation of 3 kHz at 56 db gain).

Figure 3:
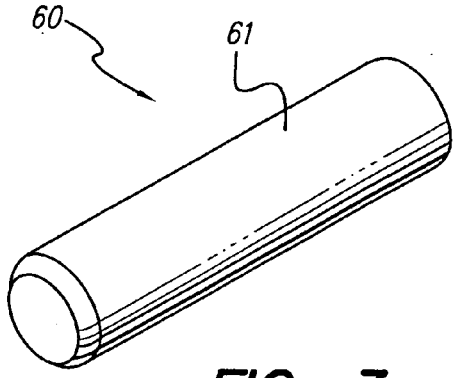
FIG. 3 is an isometric view of an embodiment of a device that may be implanted into the recess under the skin of the retro-auricular space.

In some embodiments, implant 60 is configured in one piece, as illustrated in FIGS. 2A, 2B, and 3. That is, implant 60 may be housed in a substantially cylindrical one-piece case 61, which case is hermetic and sized to fit within recess 40. Such case 61 may be made from one or more body compatible materials, such as ceramic, stainless steel, titanium, or the like. For instance, a case of titanium or stainless steel may be coated (e.g., over-molded) with a polymeric coating (e.g., silicone, Teflon®, or the like) to produce a smooth, contoured outer surface that preferably minimizes erosion of the tissue in contact with the housing. Further, case 61 may assume a variety of other suitable shapes, e.g., spherical, oval, rectangular, or other shape.

In some embodiments of the invention, the entire case 61, or portions of the case 61, may be coated, or otherwise include (e.g., may elude) biocompatible material(s) to promote healing, resist infection, and/or facilitate integration with tissue. For instance, case 61 may be coated with a steroid(s) or other drug(s) adapted to minimize the risk of infection and/or inflammation. As used herein, steroids or drugs include, but are not limited to anti-inflammatories, antibiotics, antimicrobials, and other such beneficial drugs and substances. Such steroids or drugs may be encapsulated in a film or coating designed to slowly release the steroids or drugs over a relatively long period of time, e.g., several days or weeks, thereby preventing or minimizing infection and/or inflammation during the time the tissue around the recess 40 heals.

Representative materials that may be used to coat the case in accordance with this aspect of the invention include steroids, such as a corticosteroid (e.g., corticosterone, cortisone, and aldosterone) or other drugs, either naturally occurring or synthetic, that prevent, minimize, and/or treat infection and/or inflammation. Representative materials that may be used to facilitate integration with surrounding tissue in accordance with this aspect of the invention include a thin porous film of, e.g., polymeric material such as polyurethane or Dacron®, and/or a multi-layer cross-winding of fibers. Such fibers can be metal or any other well known material (e.g., titanium, polyurethane, or the like) that promotes in-growth. The diameter of the fiber(s), the distance between the fibers (i.e., number of winds per unit length) and the pitch of the wind will determine the porosity of the resulting material.

Figure 4A:
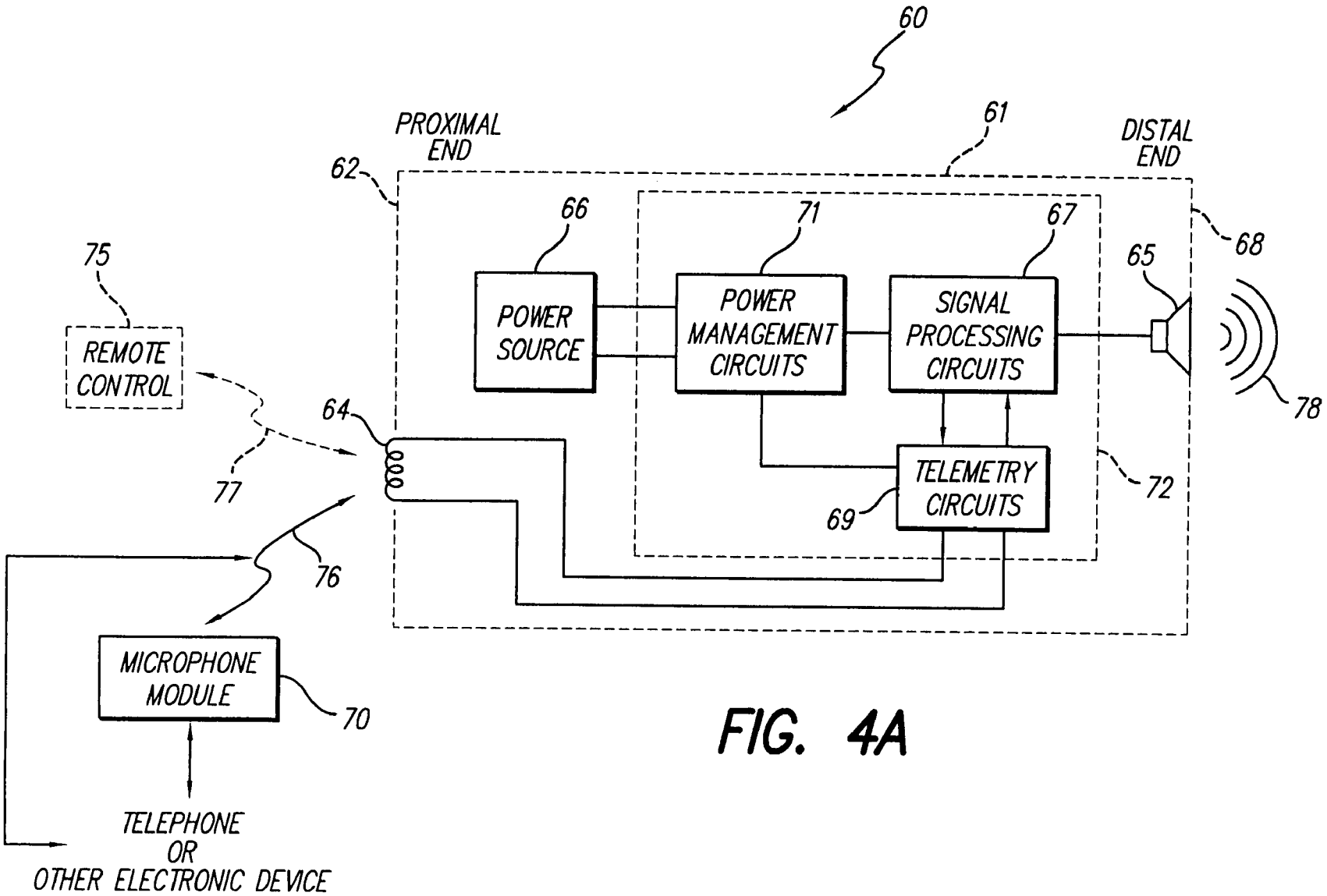
FIG. 4A is an electrical block diagram of an implant of the present invention.

FIG. 4A is an electrical block diagram of implant 60 of the present invention, housed or encapsulated within a tubular (or other suitably-shaped) hermetic case 61. An antenna(s) 64 may located at a proximal end 62 of implant 60, as shown, or may be in any other suitable position. An acoustic transducer 65, e.g., a speaker, is preferably located at a distal end 68 of implant 60. Implant 60 further includes a power source 66, signal processing circuits 67, telemetry circuits 69, and power management circuits 71, which circuits are contained on an electronic circuit board(s) 72, along with other required electronics, as discussed presently.

Antenna(s) 64 receive radio-frequency (RF) signals containing audio information in analog or encoded digital form, and transmit this information to electronic circuits 72 for processing. Telemetry circuits 69 include a receiver to acquire, filter, and process the telemetered data in either analog or digital form. In addition, antenna(s) 64 receive charging electromagnetic energy to charge power supply 66. This energy is transmitted through telemetry circuits 69 to power management circuits 71. Power management circuits 71 control, for instance, battery charging, if a rechargeable battery is used, and manage the power provided by power source 66, e.g., a rechargeable battery, to the other implant components.

When a rechargeable battery (which may actually be more than one battery) is used for implant 60, an auxiliary device to charge the battery is required. A recharging headset, resembling headphones, fits over the ears, and is thus physically close to the implant(s). This headset is designed with a coil that electro-magnetically couples RF energy to antenna 64 within implant 60 in order to charge the battery. Such a design allows simultaneous charging of batteries for users with implants for each ear. Additionally, the headset can contain a pair of miniature speakers, permitting music to be played during the charging interval. Alternatively, a special pillow with a built-in coil can be used to charge the battery while the user is reclining or sleeping.

The battery charger itself may be powered by a self-contained larger battery, permitting complete mobility during the implant charging process. This larger battery may be periodically recharged using an electrical outlet, or could be a disposable primary cell. Alternatively, the battery charger may be connected to an electrical outlet during charging of the implant battery.

Transducer 65 converts electrical energy to acoustic energy (i.e., transduces the electrical signals received into audio sound waves 78). Transducer 65 may be a conventional hearing aid speaker, e.g., a Knowles model FK_3451 (available from Knowles Electronics of Itasca, Ill.), or can be any piezo, electromagnetic, or other actuation means coupled to a flexible diaphragm, which diaphragm could be a part of the case 61. Examples of flexible diaphragms are thin membranes of etched titanium, platinum, iridium, nitinol, or any material which can be made into a thin membrane and attached to the case 61 in a manner that maintains hermeticity, for instance, via welding.

As seen in FIG. 4A, transducer 65 is connected to signal processing circuitry 67. Such signal processing circuitry 67 includes controllers and decoder circuitry, if needed, to convert data into audio signals, and filters and amplifiers to couple power to transducer 65. In addition, if required, the signal processing circuitry 67 will process the signals received by the implant 60 from the microphone module 70 so that the sounds emitting from transducer 65 are compatible (e.g., temporally matched) with the sounds traveling naturally through ear canal 30. Optionally, the signal processing circuits may also contain circuitry that performs other electronic or signal processing functions, such as voice command recognition.

Figure 4B:
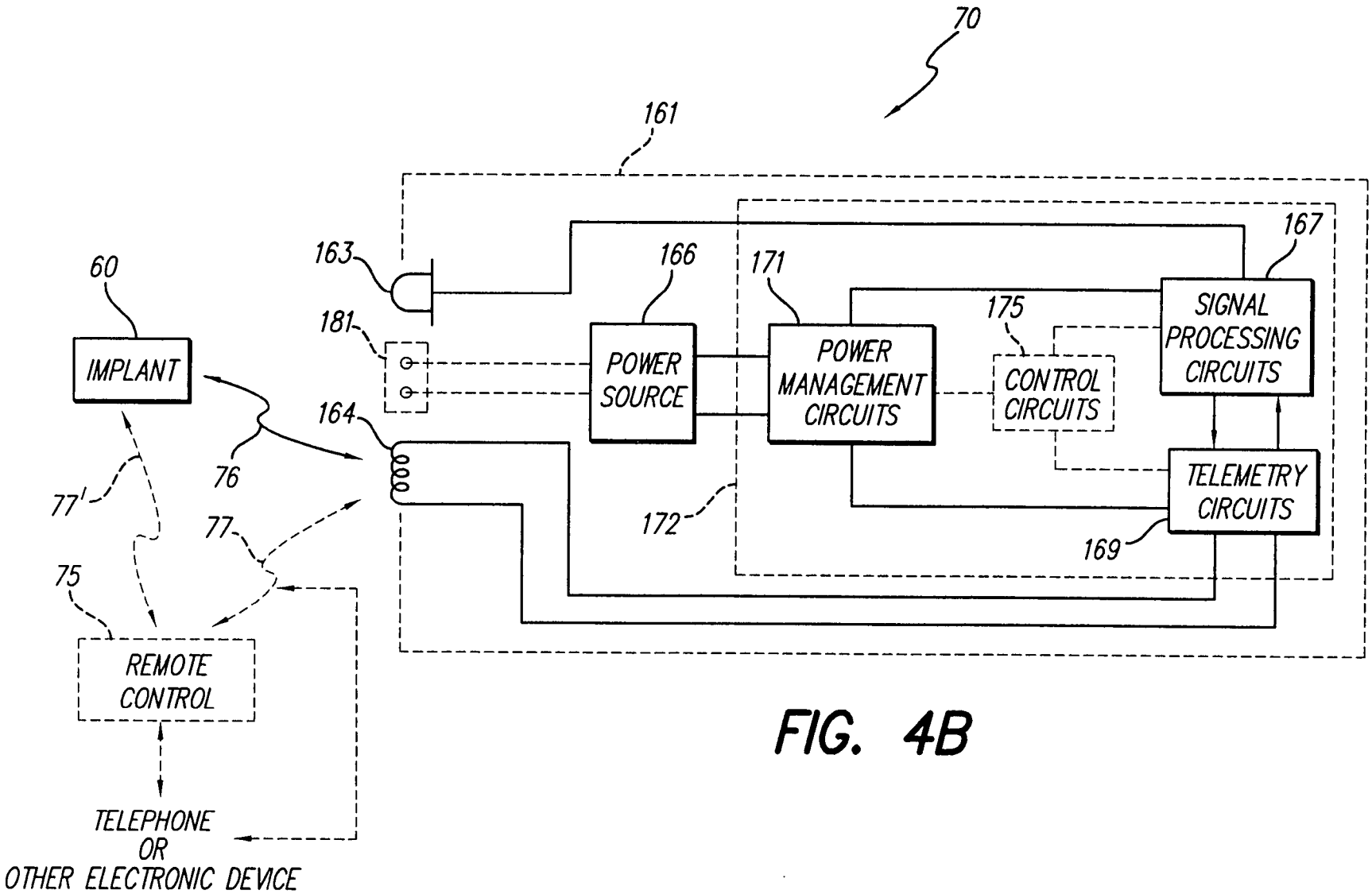
FIG. 4B is an electrical block diagram of an external microphone module of the present invention.

FIG. 4B is an electrical block diagram of microphone module 70 of the present invention, which module may be worn by the user, for instance, on or under the clothing, as described earlier. Microphone module 70 includes a microphone(s) 163, an antenna(s) 164, power source 166, and electronics 172. Electronics 172 include signal processing circuits 167, telemetry circuits 169, power management circuits 171, optional control circuits 175, and any other required electronics.

Microphone 163 may be a traditional miniature hearing aid microphone, and is preferably flexibly mounted to minimize the impact of shock and to resist pick-up of extraneous noise, e.g., due to the movement of clothing. More than one microphone, e.g., an array of microphones, can be employed. Multiple microphones may allow selectable modes of sound reception, e.g., speech focused in front of the user versus multi-directional sound.

Sounds sensed through microphone 163 may be transduced by the microphone into electrical signals and/or may be transduced or further processed by signal processing circuits 167. For instance, signal processing circuits 167 may amplify, filter, and optimize the sound information received from microphone 163 in analog or digital form. Signal processing circuits 167 may further convert the information into a format suitable for transmission to the implant, e.g., streaming audio modulating an FM signal or compressed encoded digital signals suitable for decoding with the implant. Telemetry circuits 169 couple the signals to an antenna(s) 164 for transmission via a link 76 to implant 60.

As seen in FIG. 4B, microphone module 70 also includes a power source 166 coupled to power management circuits 171. Power source 166 is preferable (but not necessarily) a battery. For instance, the battery may be a disposable primary battery or may be a rechargeable battery. If rechargeable, power may be received via antenna 164 and telemetry circuits 169 and/or via an optional connector 181 on the case of microphone module 70.

Microphone module 70 may optionally contain control circuits 175 accessible via a user interface on module housing 161. Such an interface provides user control to certain parameters associated with the operation of implant 60, such as the amplitude of signal 78 that is emitted from acoustic transducer 65 (i.e., volume control), or the frequencies of the signals (i.e., tone control) that are allowed to be emitted from the acoustic transducer 65. As such, the user interface may include an on/off switch, a volume control, capability to switch between various sound processing programs or hearing profiles (e.g., via a knob), an indicator of remaining implant and/or microphone module power, and the like.

The user interface and control circuits 175 may be included in microphone module 70 and/or may be included in a separate remote control 75. When used, such remote control 75 includes means for establishing a telemetry link 77 with telemetry circuits 169 of microphone module 70 through antenna 164 and/or means for establishing a telemetry link 77' with telemetry circuits 69 of implant 60 through antenna 64. For instance, microphone module(s) 70 may be worn as an earring or earrings, or other ornamental object, with remote control unit 75 located elsewhere.

Link 76, 77, and/or 77' may be an RF link, or may be any other suitable type of communications link, such as an infrared link, or a magnetic link. In some embodiments, the signals sent and received by telemetry circuits 69 and/or 169 are coded so only designated target and source devices can be linked through telemetry links 76, 77, and/or 77'. One possible RF communications link that may be used for links 76, 77, and/or 77' is known as Bluetooth. A Bluetooth link advantageously has an identification (ID) code for each device incorporated into its protocol.

As indicated above, the primary function of implant 60 and microphone module 70 is as a hearing aid device. That is, sounds sensed through microphone 163 are amplified, filtered and processed, and presented to transducer 65. Any type of signal processing (a.k.a. sound processing) may be employed, as is known in the hearing aid art (e.g., different frequency responses), in order to enhance the ability of the user to benefit from the sound amplification. Different signal processing strategies may be selected through the user interface on the microphone module 70 and/or remote control 75, and may be modified, from time to time, as needed or desired.

An external programming unit, such as remote control 75, microphone module 70, or a separate device, may allow an audiologist or other medical personnel to initially program the hearing aid with a customized hearing profile(s), or make programming adjustments after some amount of use, so that it best suits and meets the needs and preferences of the user. Programming may include adjusting the hearing aid to utilize a desired frequency response or signal processing strategy. The external programming unit may communicate via link 77, 77', connector 181, or an additional connector, or may be connected to or linked through a telephone land line, wireless cellular network, or other wireless communications network, in order to allow someone, e.g., personnel at a remote medical facility or health care clinic, to assist in the programming operation.

Microphone module 70 and/or implant 60 may also accept direct input from commercial electronics devices, such as telephones (land line or cellular network such as USTM network), computers, personal digital assistants, televisions, DVD players, CD players, AM/FM and/or two way radios, and the like. This information can be communicated to microphone module 70 via direct electrical connection (e.g., connector 181). Implant 60 and/or microphone module 70 may employ telemetry communication techniques (with antenna 64 and telemetry circuits 69 or antenna 164 and telemetry circuits 169, respectively), such as are currently utilized in existing hearing aid systems.

In some embodiments, connector 181, or other connector located on module 70 allows use of a remote microphone(s) 163, such as auxiliary microphones. Such microphone(s) 163 may be, e.g., clipped to the user's clothing. As mentioned earlier, multiple microphones may allow binaural hearing and/or selectable sound reception, e.g., for speech focused in front of the user versus multi-directional sound. The connector may also serve as an input for an external signal source from a commercial electronics device, as described above.

Again, one or more microphones 163, microphone modules 70, and/or implants 60 may be used. For instance, fully assisted binaural hearing can be provided using an implant for each ear. These implants could simultaneously communicate with one centrally located microphone module 70 containing two directional microphones or microphone arrays configured to preferentially recover sound independently from each side of the body. In such a case, microphone module 70 would contain two channels for sound processing and transmission, selectively transmitting sound from each side of the body to the respective implant 60 located at each ear of the user. Alternatively, two or more microphone modules 70, communicating with one or two implants 60, may be positioned to maximize sound recovery, which may be microphone-position dependent.

Figure 5A:
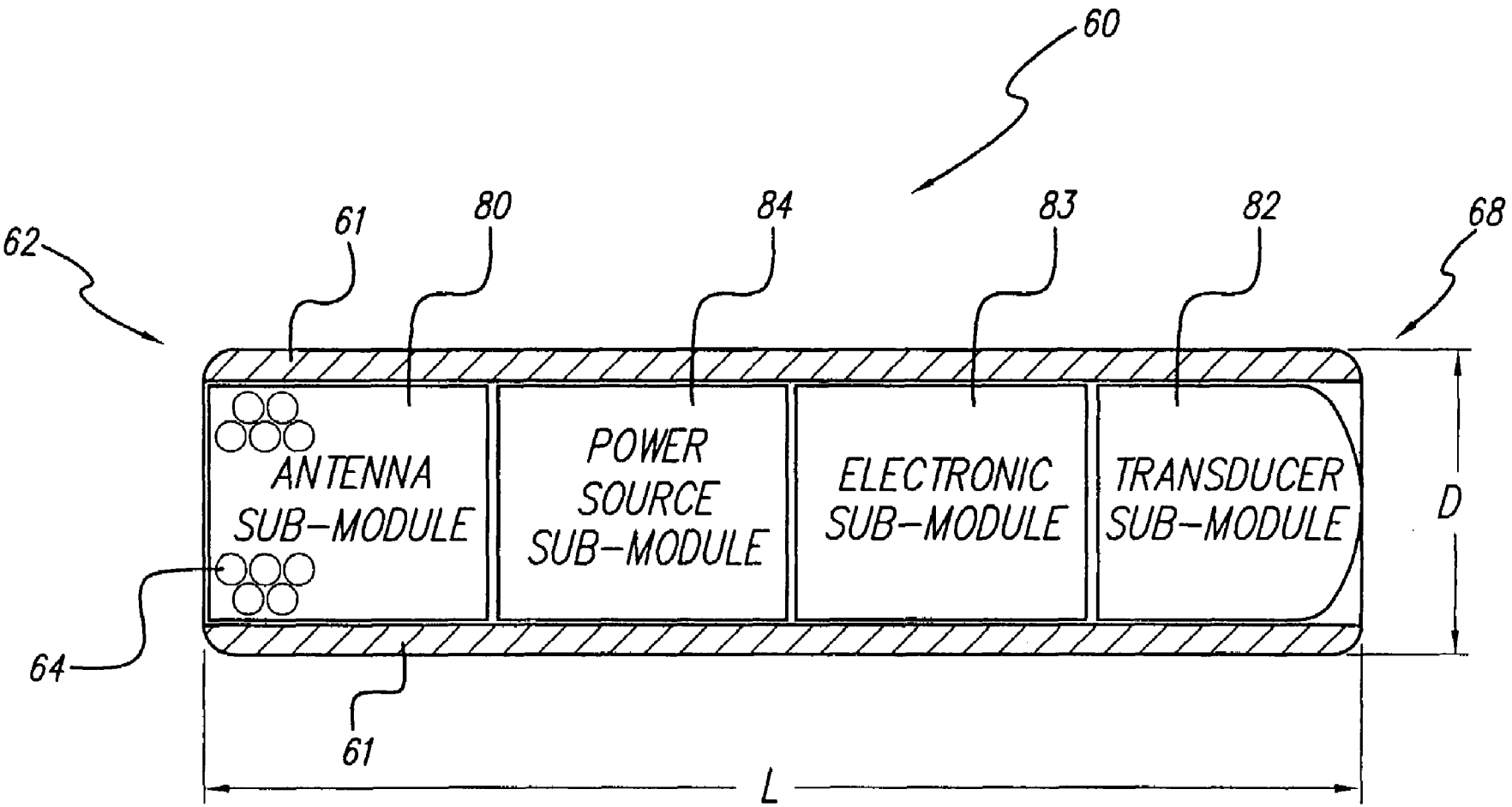
FIG. 5A illustrates an exemplary embodiment of the implant of the present invention.

Turning next to FIG. 5A, a representative packaging scheme for implant 60 is illustrated. The case 61 of implant 60, in this instance, is tubular in shape. Case 61 may have a ribbed, scored, or otherwise roughened outer side wall, which may be preferable when inserted directly into recess 40, or may have a smooth outer side wall, or coating, for all or portions of case 61. As described earlier, case 61 may be coated with a steroid(s) or other drug(s) adapted to minimize the risk of infection and/or inflammation, and/or with a substance promoting tissue growth. The steroid(s) or other substance(s) may be embedded in a suitable carrier that dissolves over time, thereby eluting or dispensing the steroid/substance to the surrounding tissue over a period of time.

The case 61 has a diameter D sized to fit snugly within recess 40. Further, case 61 has a length L such that when implant 60 is properly placed in recess 40, the proximal end 62 of implant 60 will be located near the proximal end 48 of recess 40 (i.e., just under the skin of the retro-auricular space), and the distal end 68 of implant 60 will be near the distal end 38 of recess 40.

For embodiments illustrated by FIG. 5A, there are four sub-modules end-to end inside tubular case 61. At proximal end 62 of implant 60 is an antenna sub-module 80. In some embodiments, coil windings of antenna 64 are physically located within antenna sub-module 80. However, antenna 64 may be positioned in other locations within module 60. For instance, antenna 64 may be built into case 61. In another exemplary configuration, an antenna wire may emerge from case 61, which wire may be, but is not necessarily, fixed to the case.

At the distal end 68 of tubular case 61 of implant 60 is a transducer sub-module 82. An electronics sub-module 83 and a power source sub-module 84 fill the remaining space within case 61. The electronics sub-module 83 includes the signal processing circuits 67, telemetry circuits 69, and power management circuits 71. Power source sub-module 84 includes a suitable power source 66, such as a rechargeable battery and/or super capacitor, and possibly additional charging/replenishing circuitry. Thus, charging/replenishing circuitry may be found in electronics sub-module 83 and/or within power source sub-module 84. The power source may comprise a rechargeable battery of the same or similar type as is disclosed, e.g., in U.S. Pat. Nos. 6,185,452; 6,164,284; and/or 6,208,894, which patents are incorporated herein by reference.

Figure 5B:
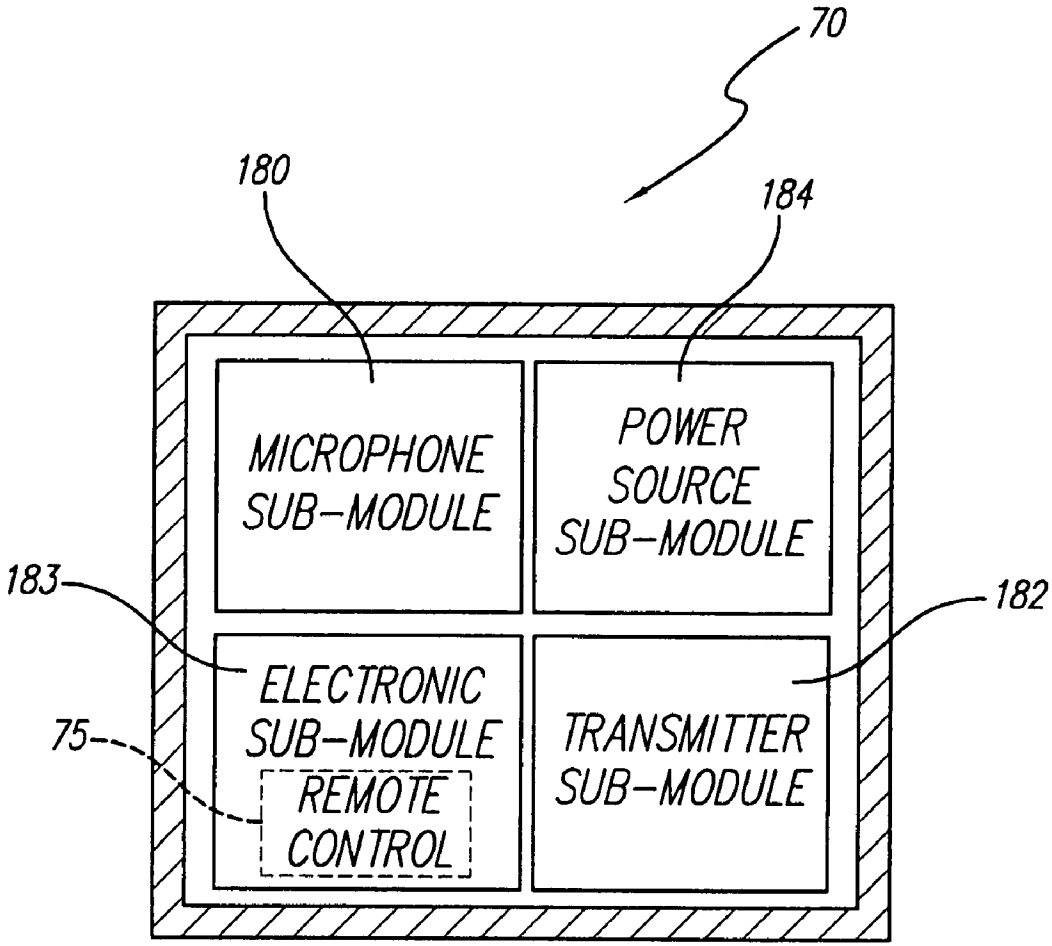
FIG. 5B illustrates an exemplary embodiment of the microphone module of the present invention.

Turning next to FIG. 5B, a representative packaging scheme for the microphone module 70 is illustrated. In the illustrated design, there are four sub-modules inside module 70: microphone sub-module 180, transmitter sub-module 182, electronics sub-module 183, and power source sub-module 184.

In one embodiment, coil windings of antenna 164 are physically located within transmitter sub-module 182. Alternatively, antenna(s) 164 may be positioned remotely from module 70 and/or in other locations within module 70; for instance, antenna 164 may be built into the housing 161 of microphone module 70.

The electronics sub-module 183 includes the signal processing circuits 167, telemetry circuits 169, and power management circuits 171. Electronics sub-module 183 may further include components required for remote control 75, including a user interface. The power source sub-module 184 includes a suitable power source 166, such as a primary battery, rechargeable battery, and/or super capacitor. Charging/replenishing circuitry, if needed, may be located in electronics sub-module 183 or in power source sub-module 184.

Turning next to the examples of FIGS. 6A, 6B, 7A, 7B, and 7C, implant 60 may be configured in two or more pieces that connect together, which allows, inter alia, the overall length of implant 60 to be variable. For instance, length L may range from about 10 mm to about 40 mm.

Figure 6A:
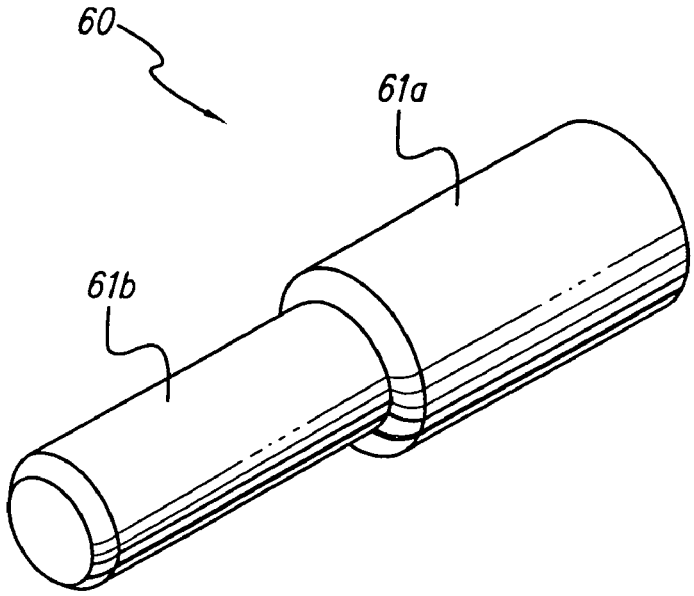
FIG. 6A is an isometric view of an alternative implant configuration.
Figure 6B:
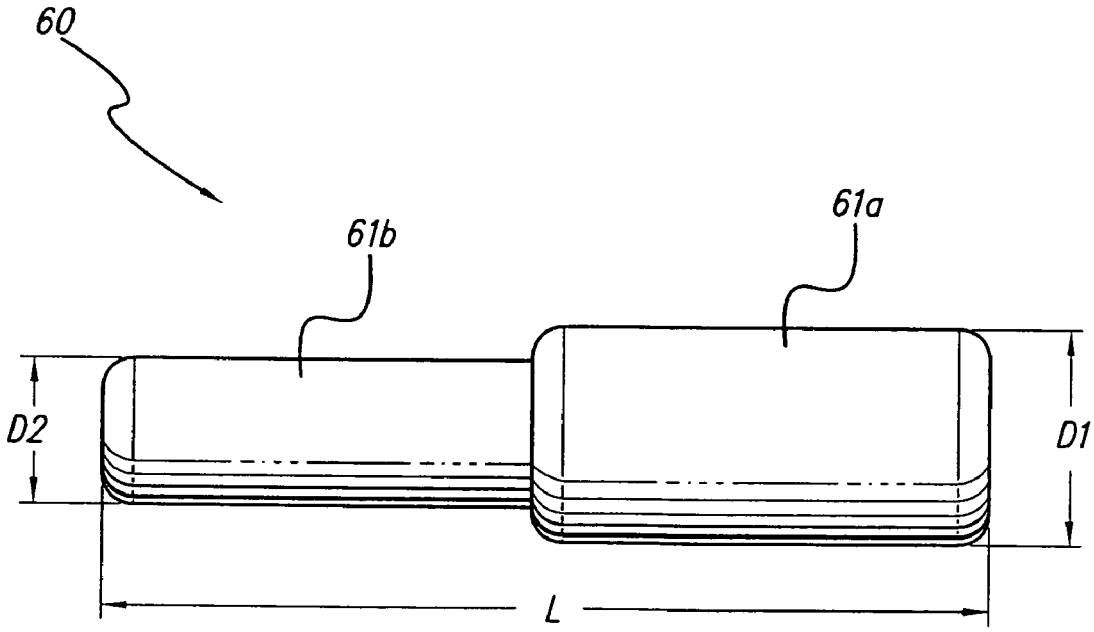
FIG. 6B is a side view of the implant of FIG. 6A.

As shown in FIGS. 6A and 6B, implant 60 may comprise a hermetic housing 61*a* and a tube 61*b* attached to hermetic housing 61*a*. In such an embodiment, hermetic housing 61*a* may include electronic circuitry 72, antenna 64, and power source 66. Transducer 65, having a diameter D1 of about 3 mm, may be contained within housing 61*a* or within tube 61*b*. Tube 61*b* may have a diameter D2 of about 4 mm.

If hermetic housing 61*a* includes the transducer 65, tube 61*b* is preferably connected to housing 61*a* at a location close to transducer 65. In such a configuration, tube 61*b* transmits acoustic energy from hermetic housing 61*a* along the length of tube 61*b*, with the acoustic energy exiting at the distal end of tube 61*b*. For instance, sound waves applied by a speaker 65 to the wall of housing 61*a* could be conductively coupled through tube 61*b* into ear canal 30. Tube 61*b* may be an open tube with a hollow internal lumen, and may be open at its distal end, or the distal end of tube 61*b* may be closed by means of a compliant membrane. Alternatively, tube 61*b* may be a solid tube, conductively passing sound along its length. Tube 61*b* may be made from metal, such as stainless steel or titanium, or polymeric material, such as silicone or polyurethane. Hermetic housing 61*a* may be made from one or more body compatible materials, such as ceramic, stainless steel, titanium, or the like.

In another alternative, transducer 65 is positioned in, or, preferably, at the distal tip, of tube 61*b*, rather than in housing 61*a*. In such embodiments, a pair of miniature electrical wires run through tube 61*b*, connecting transducer 65 to the amplifier(s) contained on the electronic circuit board(s) 72 within housing 61*a*. The transducer tip may thus protrude slightly into the ear canal, or reside just under the skin of the ear canal. Such placement of the transducer at the most distal point of the device permits maximum sound energy to be transmitted into the ear canal.

Figure 7A:
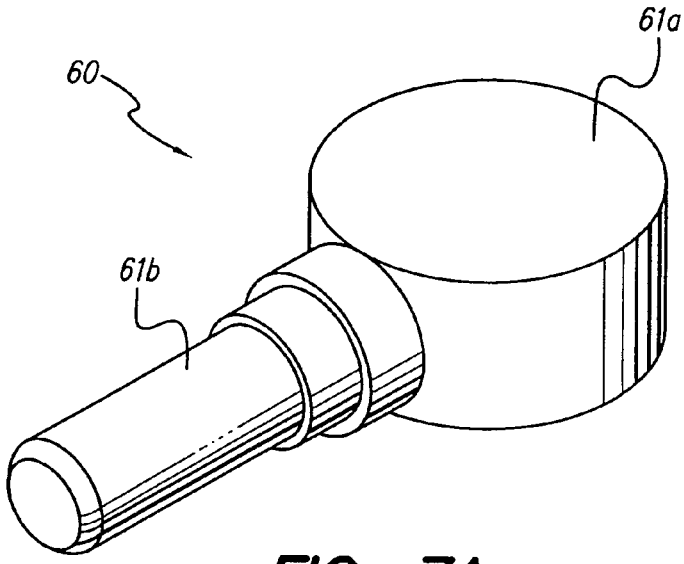
FIG. 7A is an isometric view of another possible implant configuration.
Figure 7B:
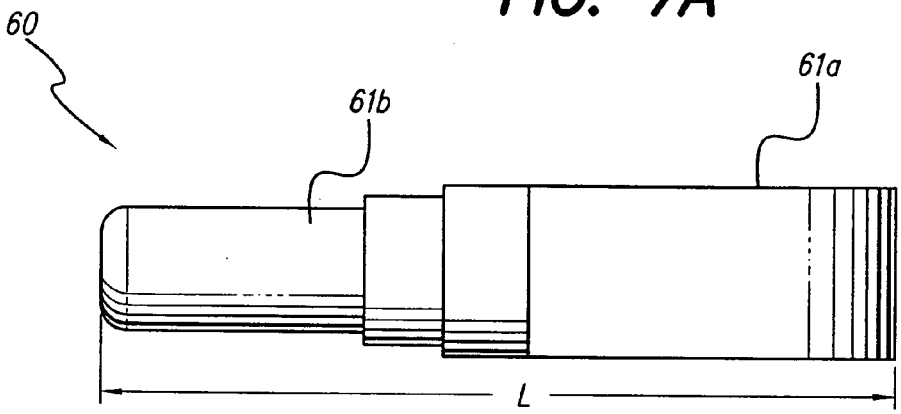
FIG. 7B is a side view of the implant of FIG. 7A.
Figure 7C:
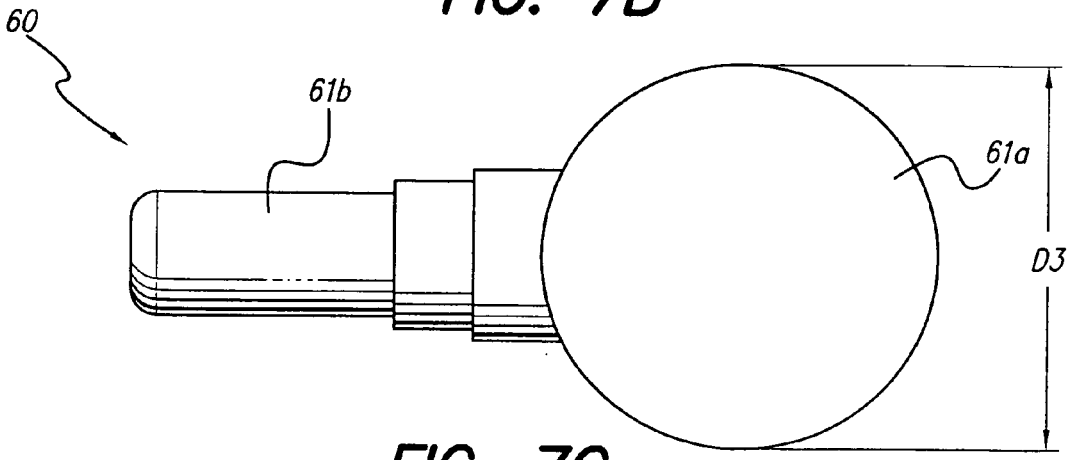
FIG. 7C is a top view of the implant of FIG. 7A.

FIGS. 7A, 7B, and 7C further illustrate that implant 60 may be made of several pieces, and that housing 61*a* and tube 61*b* may comprise a variety of shapes. For instance, housing 61*a* may be shaped like a disk with a diameter D3 of about 12 mm, as shown in FIGS. 7A, 7B, and 7C, or may be substantially spherical, oval, rectangular, or any other appropriate shape. Tube 61*b* may be cylindrical, may include a taper, which may be stepped or continuous, and may be made of a material or materials other than polymer. As discussed earlier, the entire case 61, or portions of the case 61 (e.g., housing 61*a*, tube 61*b*, and the like), may be coated, or otherwise include (e.g., may elude) biocompatible material(s) to promote healing, resist infection, and/or facilitate integration with tissue.

While the invention herein disclosed has been described by means of specific embodiments and applications thereof, numerous modifications and variations could be made thereto by those skilled in the art without departing from the scope of the invention as defined by the appended claims.

What is claimed is:

1. A hearing aid system comprising:

an implant configured for insertion into a recess under the skin of a patient's retro-auricular space for projecting acoustic energy into said patient's outer ear canal without occluding said ear canal, said implant comprising:

a case having a proximal end and a distal end, an acoustic transducer mounted in said case proximate to said distal end for producing acoustic energy;

implant electronic circuitry in said case having an output for driving said acoustic transducer;

an implant antenna electrically connected to an input of said electronic circuitry; and a power source electrically connected to said electronic circuitry;

a microphone module configured for use external to said case, said module comprising:

a housing;

external electronics within said housing;

at least one microphone electrically connected to an input of said external electronics;

at least one external antenna electrically connected to an output of said external electronics;

a power source electrically connected to said external electronics; and at least one telemetry link between said external antenna and said implant antenna, and wherein audible sound received by said microphone is processed by said external electronics and transmitted by said telemetry link to said implant electronic circuitry for causing said transducer to project acoustic energy into said patient's outer ear canal.

2. The hearing aid system of claim 1 wherein the transducer is located at a distal end of the case, which distal end is positioned under the skin of the ear canal.

3. The hearing aid system of claim 1 wherein the transducer is located at a distal end of the case, which distal end protrudes slightly into the ear canal.

4. The hearing aid system of claim 1 wherein the implanted power source comprises a rechargeable battery.

5. The hearing aid system of claim 1 wherein the implanted power source comprises a super capacitor.

6. The hearing aid system of claim 1 wherein the implant case comprises one piece.

7. The hearing aid system of claim 1 wherein the implant case comprises more than one piece.

8. The hearing aid system of claim 1 wherein at least one microphone of the microphone module is located remotely from the microphone module.

9. The hearing aid of claim 1 wherein at least one external antenna of the microphone module is located remotely from the microphone module.

10. The hearing aid system of claim 1 further comprising a coating on at least part of the implant case, which coating comprises at least one material for at least one of promoting healing, resisting infection, resisting inflammation, and facilitating integration of the implant with body tissue.

11. The hearing aid system of claim 1 further comprising signal processing circuitry for processing sensed signals and presenting processed signals that are compatible with sounds traveling naturally through the ear canal.

12. The hearing aid system of claim 1 further comprising signal processing circuitry that performs voice command recognition.

13. The hearing aid system of claim 1 further including means for communicating with a commercial electronics device.

14. The hearing aid system of claim 13 wherein the means for communicating includes a telemetry communication technique.

15. The hearing aid system of claim 13 wherein the means for communicating includes a direct electrical connection.

16. The hearing aid system of claim 1 further comprising:

at least one external programming unit for customizing the hearing aid for a user; and means for communicating with the at least one external programming unit.

17. The hearing aid system of claim 16 wherein the at least one external programming unit is a remote control.

18. The hearing aid system of claim 17 wherein the microphone module includes the remote control.

19. A hearing aid system including:

a case, having a proximal end and a distal end, configured for implantation in a patient's body with said case proximal end subcutaneously implanted proximate to a patient's retro-auricular space and said case distal end implanted proximate to said patient's outer ear canal;

microphone means remote from said case for generating an output signal representative of audible sound;

signal processing circuitry in said case responsive to said microphone output signal for producing an electric drive signal;

wireless telemetry means for coupling said microphone output signal to said signal processing circuitry; and an acoustic transducer in said case proximate to said distal end responsive to said electric drive signal for projecting an acoustic output signal into said patient's outer ear canal.

20. The system of claim 19 wherein said microphone means for generating said output signal comprises a housing external to said patient's body, said housing including a microphone.

21. A hearing aid system comprising:

an implant configured for insertion into a recess under the skin of a patient's retro-auricular space for projecting acoustic energy into said patient's outer ear canal without occluding said ear canal, said implant comprising:

a case having a proximal end and a distal end, acoustic transducer means mounted in said case proximate to said distal end for producing acoustic energy;

implant circuit means in said case for supplying a drive signal to said acoustic transducer means;

a microphone module external to said case, said module comprising:

a housing;

microphone means in said housing for converting sound energy to a representative electric signal; and means for wirelessly communicating said representative electric signal to said implant circuit means for driving said acoustic transducer to project acoustic energy into said patient's outer ear canal.

* * * * *